US006691620B2

(12) United States Patent
Riepenhoff

(10) Patent No.: US 6,691,620 B2
(45) Date of Patent: Feb. 17, 2004

(54) PROCESS AND DEVICE FOR THE DETECTION OF A POSITION OF A PAPER WEB

(75) Inventor: Matthias Riepenhoff, Bern (DE)

(73) Assignee: Maschinenfabrik Wifag, Bern (CH)

( * ) Notice: Subject to any disclaimer, the term of this patent is extended or adjusted under 35 U.S.C. 154(b) by 0 days.

(21) Appl. No.: 10/233,187

(22) Filed: Aug. 28, 2002

(65) Prior Publication Data

US 2003/0041763 A1 Mar. 6, 2003

(30) Foreign Application Priority Data

Aug. 31, 2001 (DE) ..... 101 12 636

(51) Int. Cl.[7] ..... B41F 1/54

(52) U.S. Cl. ..... 101/483; 101/484; 250/339.07; 250/339.1; 226/2

(58) Field of Search ..... 101/483, 484; 250/339.07, 339.1; 162/263; 226/2, 45

(56) References Cited

U.S. PATENT DOCUMENTS 4,319,847 A * 3/1982 Howarth ..... 356/431
4,733,078 A * 3/1988 Sturm ..... 250/339.1
4,737,035 A * 4/1988 Aoki et al. ..... 356/445
5,050,994 A * 9/1991 Kipphan et al. ..... 356/445
5,233,195 A * 8/1993 Hellstrom et al. ..... 250/360.1
5,452,632 A 9/1995 Dürr et al.
5,546,861 A * 8/1996 Loffler ..... 101/484
6,185,001 B1 * 2/2001 Webendorfer et al. ..... 358/1.2
6,257,144 B1 * 7/2001 Erhardt et al. ..... 101/484
6,391,158 B1 * 5/2002 Metzler et al. ..... 162/198
6,495,831 B1 * 12/2002 Hyvarinen et al. .... 250/339.07

FOREIGN PATENT DOCUMENTS

| | | |
|---|---|---|
| DE | 42 34 308 | 4/1994 |
| DE | 199 10 835 | 9/2000 |
| JP | 08230141 | 9/1996 |

* cited by examiner

*Primary Examiner*—Andrew H. Hirshfeld
*Assistant Examiner*—Andrea H. Evans
(74) *Attorney, Agent, or Firm*—McGlew and Tuttle, P.C.

(57) ABSTRACT

A process is provided for detecting the position of a paper web, especially in wet offset printing, wherein a strip free from ink or moistening agent is detected. A device is provided for detecting the position of a cut web, especially in wet offset printing. The device has a sensor for detecting the water content in the paper web.

14 Claims, 4 Drawing Sheets a)

b)

PROCESS AND DEVICE FOR THE DETECTION OF A POSITION OF A PAPER WEB

FIELD OF THE INVENTION

The present invention pertains to a process and a device for the detection of the position or register position of a paper web, especially in wet offset printing.

BACKGROUND OF THE INVENTION

Newspapers are produced predominantly according to the offset process. A plurality of paper webs are wound off from rolls, printed in the printing units and finally folded in the folding apparatus and cut. While one paper web is running through the press, it is continuously in a stretched state. Paper comes in contact with water and ink during wet offset printing, whereby the stretching properties of the papers are changed. The paths over which the individual paper webs run have different lengths. The addition of water and ink is not the same for all printing mechanisms. Various guide elements are used in order to turn the webs and to optimize the run of the web. The stretching properties also vary between different grades of paper and different paper weights, and there are tolerances in the elastic properties of the paper from one roll to the next and even within one roll even within the same grade of paper.

The printed webs are first folded into bundles in the folding apparatus, and the bundles are subsequently cut such that the cut is located outside the printing area of the pages. Errors in the cutting position make it impossible to sell the newspapers. The cutting position can be adjusted by the printer by adjusting the web length between the printing mechanism and the cutting position by means of so-called compensator rollers. It is also possible to set the cutting position by an equal adjustment of the printing positions of all printing mechanisms and thus to do away with a register roller (which is also called virtual main crop mark). A separate compensator roller is necessary for one half of the divided web in the case of double-width webs that are divided and placed one over another before the entry into the folding apparatus. The so-called secondary register is thus set.

Difficulties arise during the correct cutting of the bundled webs in the folding apparatus from the different paths of each web and the different stretchings, which the paper webs undergo during the run through the printing press. When similar productions are repeated, the cutting position is approximately known and can be roughly preset from the beginning. In fact, the printer must, however, accurately set the cutting position at the beginning of each production. This results in a certain number of spoiled copies and a loss of time during the production.

Processes that make possible the rapid, automatic regulation of the cutting position have been known. Measuring fields of various sizes are printed along, which are detected by suitable sensors shortly before the folding apparatus and thus provide a measuring reference, which can be used to regulate the cutting position. A large measuring mark, which is placed at the edge of the page that is not used for printing, can be detected, e.g., by a photodiode, but it compromises the overall visual impression. Smaller marks can be recognized by video cameras in conjunction with a digital pattern recognition. The drawback of both processes is that additional marks must be printed along. The technical effort for the recognition of these marks increases, in general, with decreasing size of these marks.

Another possibility of recognizing errors in the cutting position has been known from DE 199 10 835 C1, in which the printed image in two areas are scanned. The first scanning at the outlet of the printing mechanism forms the reference, with which the scanning before the entry into the folding apparatus is compared. The position errors can be determined from the correlation of the signals and used for the regulation. The drawback of this process is that a plurality of sensors are necessary and these must be placed suitably.

SUMMARY OF THE INVENTION

One object of the present invention is to provide a process and a device especially for wet offset printing, which are able to automatically recognize the position or register position.

According to the present invention, the position or register position of a paper web, especially in wet offset printing, is detected by detecting strips of the paper web that are free from moistening agent. In addition or as an alternative, it is also possible to detect a strip in which there is no printing ink.

The device according to the present invention for detecting the position of a paper web, especially in wet offset printing, has a sensor, with which a moistening agent, e.g., water, or the water content in a paper web can be detected. According to a second embodiment, the same sensor or another sensor is used to detect printing ink on the paper web. An evaluating unit, with which the sensor signals can be evaluated and the moistening agent content of a paper web can be detected, is preferably provided.

According to another aspect, the present invention pertains to the regulation of the position of a paper web using the detected position, so that the cutting length of the paper web can be set, e.g., based on the detected printing ink-free or moistening agent-free strip, e.g., by the automatic actuation of a compensator roller.

The principle of function of the present invention will be described below.

Wet offset printing is based on the different surface tensions of the moistening agent and the printing ink. The process has been described several times and shall not be explained in greater detail here. The only thing that should be referred to here is the circumstance that water also comes into contact with the web besides the printing ink during the printing on the paper web, doing so on the area that approximately corresponds to the printing area. However, no water is transferred to the paper web in the area of the clamping device of the printing plates. The amount of moisture entering the paper depends on the number of printing mechanisms that come into contact with the web and, in addition, on the amount of moistening agent that is used in the particular printing mechanism. A page of a newspaper is usually printed on the front and the back. Consequently, depending on the number of colors used, 2 to 8 printing mechanisms are in contact with one paper web. Since each printing mechanism is set in good register, the zone free from printing ink or moistening agent forms a strip across the web, which is always located in the same area, for all printing mechanisms.

The present invention is based on the recognition of this printing ink-free or moistening agent-free strip. In fact, this area, which will hereinafter be called a channel strip, forms in a certain way an invisible marking or mask. Even though the marking formed by the moistening agent-free strip disappears after a few minutes, is it nevertheless present shortly after the printing operation and can be used to recognize or regulate the position.

The moistening agent consists mainly of water. Water is transparent, i.e., visible light is hardly absorbed by water. By contrast, water shows a marked absorption for some wavelengths in the infrared range and in the range close to the infrared. At a wavelength of 2.95 μm, water has an absorption, at which the depth of penetration for electromagnetic radiation is only about 1 μm, i.e., if such infrared light passes through a layer of water with a thickness of 1 μm, more than 60% of the radiation is absorbed. Less marked absorption maxima are located at half and one third of this wavelength. Furthermore, additional absorption peaks are found for water at the harmonic multiples of the vibration frequency of the electromagnetic radiation of the wavelength of 2.95 μm. For example, it is possible to measure absorption maxima at about 1.48 μm, 980 nm, etc. Even though the absorption is less intense there, faster and more sensitive detectors are available at these shorter wavelengths. In addition, there are powerful light sources, e.g., semiconductor lasers, which can be advantageously used for the measuring device. The semiconductor materials that can be used for detectors or light sources include, e.g., InGaAsP, Ge, Si, AgOCs, and HgCdZnTe (also known under the name MCT).

It is also possible to measure this absorption behavior in a reflection set-up. The process will be hereinafter described for the reflection measurement, but the present invention may be used in the case of transmission measurement as well.

The optical detection of water can be performed if, e.g., a radiation source for a spectral range of 2.8–3 μm and a corresponding sensor are used. If the web is illuminated by such a radiation source and the remitted radiation is measured, a lower remission is obtained for paper containing water than for dry paper. If a spot measurement is performed and, e.g., the printed paper web is moving under a stationarily arranged measuring head, a maximum signal will always be obtained at the moments at which the unprinted channel strip passes through at the measurement point. The measured area should be narrower than the width of the channel strip in order to obtain a sharp measured signal. For example, 10–20 mm may be assumed to be a typical width of a channel strip. The shape of the measured area is of secondary importance; it maybe, e.g., round or elliptical, square or rectangular or of any other shape, but it should preferably have a width of less than 5 mm and should be advantageously arranged such that its narrow side is located in the direction in which the web runs, whereas the longer extension is in the direction of the channel strip to be detected, i.e., at right angles to the run of the web. For example, the light of the radiation source may be focused for such a spot measurement, or the radiation emitted by a measured area may be focused on a detector, or the field of view of the radiation source and/or detector may be limited by means of appropriate diaphragms.

The absorption or reflection of electromagnetic radiation in the printing ink can be measured to detect the ink-free strip. If a paper web is scanned, e.g., continuously, a reflection or absorption profile can be obtained, and a reflection maximum or an absorption maximum is measured at the channel strip, which is, e.g., unprinted and white. The printed areas can also be recognized in the case of continuous scanning of the printed paper web, so that the printed information can also be detected by a sensor, and this information can also be used to detect the position of the paper web.

The detection of the printing ink-free or moistening agent-free channel strip can be performed, e.g., with a single detector with an appropriate light source and corresponding filters. It is also possible to perform absorption spectroscopy, in which case the spectrum is recorded in a certain range. The presence of the material to be detected can then be demonstrated from the absorption peaks and the absence of, e.g., moistening agent or of the ink can be determined.

Thermal radiation sources may be used as radiation sources. It is advantageous to use band pass filters in the spectral range of 2.8 μm to 3 μm, which may be arranged in front of the radiation source or the detector. Other possible radiation sources are infrared light-emitting diodes, which have an emission at about 2.9 μm. It is also possible, in principle, to use laser light sources, e.g., erbium laser or lead salt laser diodes. For example, photoconductors, which are based on lead sulfide or lead selenide, may be used as detectors. It is possible, in principle, to use any detector that is sufficiently sensitive in the wavelength range and responds sufficiently rapidly. Thus, it is possible, in principle, to detect infrared radiation with thermally operating sensors, but these have a relatively long response time. If, e.g., a channel strip width of 10 mm and a web velocity of 10 m/sec are assumed, a remission maximum appears for a duration of 1 msec. This time becomes shorter when the measuring field of the sensor becomes too large. The sensor should therefore have a response time of less than 0.5 msec, and a response time of less than 200 μsec is advantageous. The above-mentioned lead sulfide detectors have reaction times of about 200 μsec. Lead selenide detectors have reaction times of about 200 μsec. Lead selenide detectors have shorter reaction times, but are less sensitive.

If such a sensor is positioned, e.g., at a short distance in front of the entrance of the folding apparatus, the above-described recognition of the channel strip can be used to regulate the cutting position.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

The present invention will be described below on the basis of an embodiment, in which a moistening agent-free strip is used as a marking. However, the present invention can also be used to detect an ink-free area and to use it as a marking, and, e.g., different wavelength ranges of the light may be measured depending on the ink material.

Figure 1:
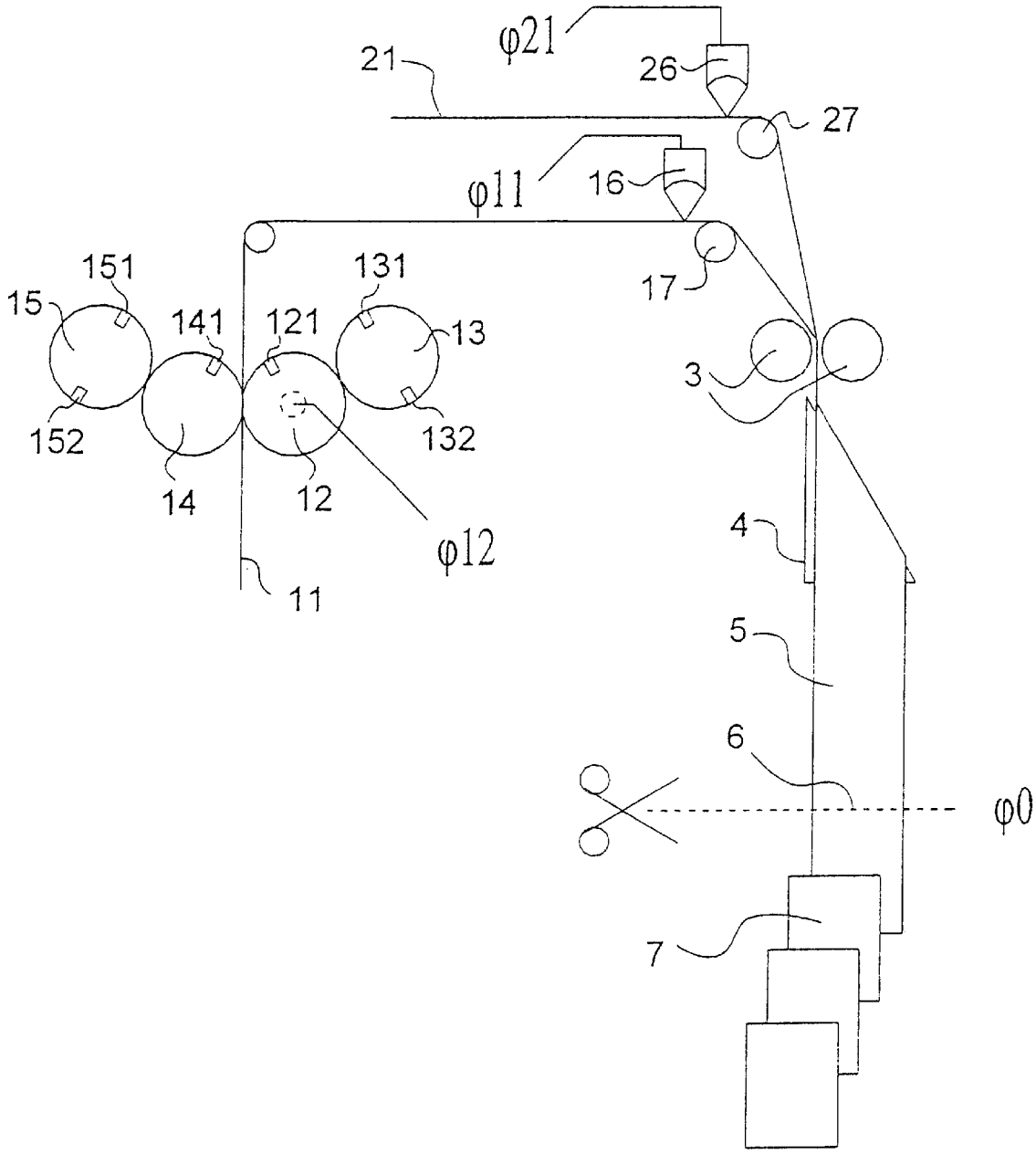
FIG. 1 is a schematic arrangement of parts of a printing press for explaining the present invention.

Referring to the drawings in particular, FIG. 1 shows a schematic arrangement of the parts of a printing press that are essential for the understanding of the present invention. A paper web 11 runs through the press and is printed on. The rubber blanket cylinders 14, 12 print on the front side and the reverse side of the paper, respectively. Neither water nor ink is transferred onto the paper in the areas of the clamping channel 141, 121 of the rubber blanket. While rubber blanket cylinders typically have a channel, printing cylinders 13, 15 with twice the circumference have two channels 131, 132 and 151, 152. Neither ink nor water is applied to the rubber blanket at these channels. Therefore, there is a strip between the printed pages, at which the paper has not taken up either ink or water. The width of this strip depends on the clamping of the plate and it typically equals a few mm.

Webs 11, 21 are led to the folding apparatus. They pass over the so-called fan, at which the webs 11, 21 are led into the funnel intake 3 via rollers 17, 27. The webs 11, 21, which are now lying one on top of another, are led over the funnel 4, and a bundle 5 is formed from the webs 11, 21.

There is a possibility of placing sensors at individual webs in the vicinity of the fan. Every individual web 11, 21 can be monitored with sensors 16, 26 here. The sensors detect the dry channel strips.

The bundle 5 is cut at the site of the folding knife 6 in the folding apparatus.

The cutting operation, the printing operation and the detection of a channel strip are operations recurring with the same periodicity. At a known press velocity, a phase angle can be assigned to each periodic operation by measuring the point in time at which it takes place. In principle, any operation of equal periodicity can be selected as the reference.

The moment of cutting at the folding knife will hereinafter be designated by the phase angle $\phi$0, the moment of recognition of a channel strip with $\phi$11, and the moment at which a channel strip is formed in the printing mechanism is designated with $\phi$12. If the path of the web and the stretching of the paper from the sensor to the folding knife are assumed to be known, a set point for the difference between $\phi$11 and $\phi$0 can be determined from this. The phase position of the printing mechanism, $\phi$11, and the cutting position, $\phi$0, are preset by the press control. Deviations from the set point can thus be determined by measuring the phase angles $\phi$11 and $\phi$21. These measured values can be used to regulate the cutting position.

Figure 2:
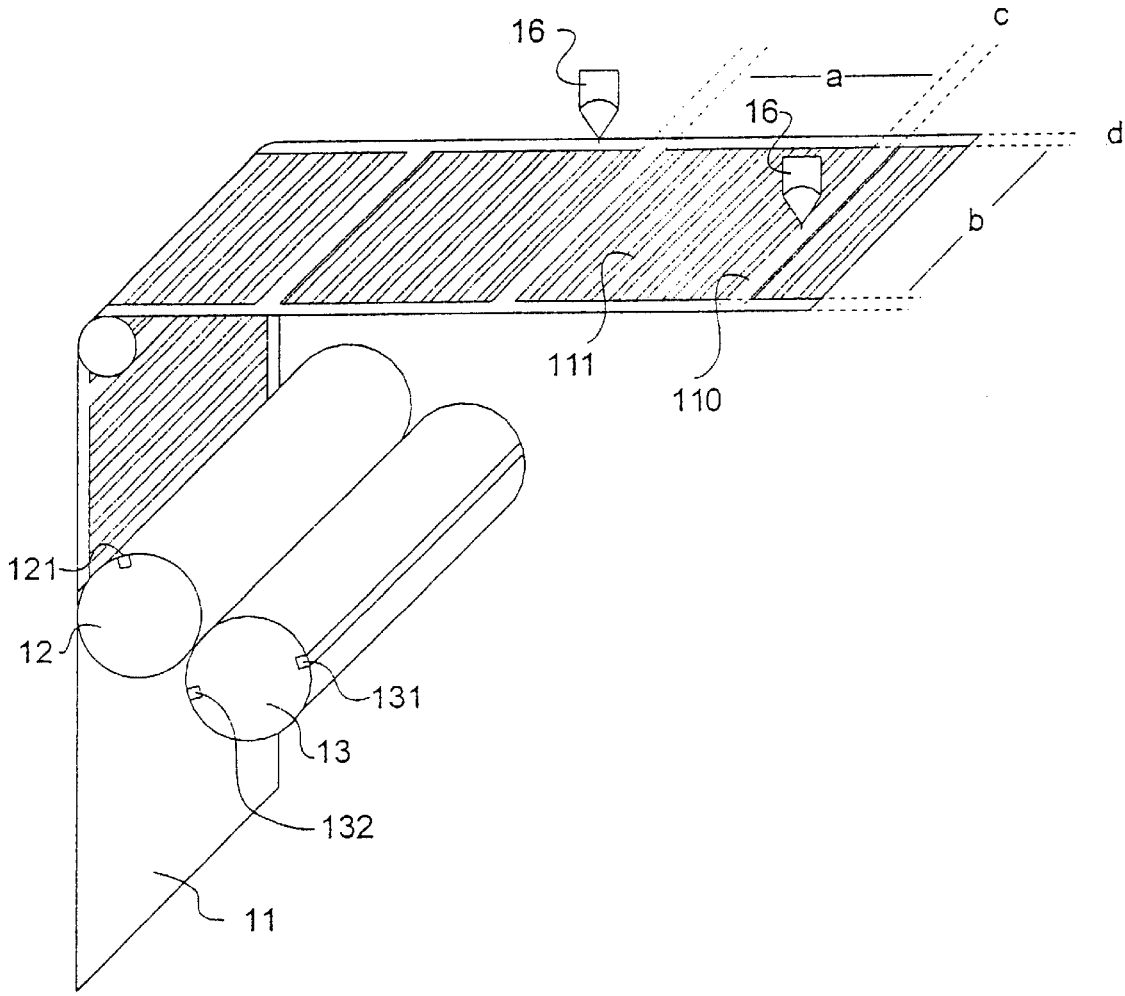
FIG. 2 is a schematic view of a printed paper web.

FIG. 2 shows a schematic view of a printed paper web. The pages have a length a and a width b. The maximum size of the page forms the printing area. An unprinted and non-moistened strip 110, which has a length c in the direction of run, is located between the printed pages 111. This strip is recognized by a sensor 16. Having the ability to measure an unprinted reference area may be advantageous for the calibration of the measurement. Since the printing area is laterally limited, there is an unprinted and non-moistened strip of a width d at the edge of the paper. For example, a sensor 16 can perform a reference measurement there. It is also possible to perform a reference measurement at the beginning of the production, during which the web just pulled in but not yet printed on is measured.

Figure 3:
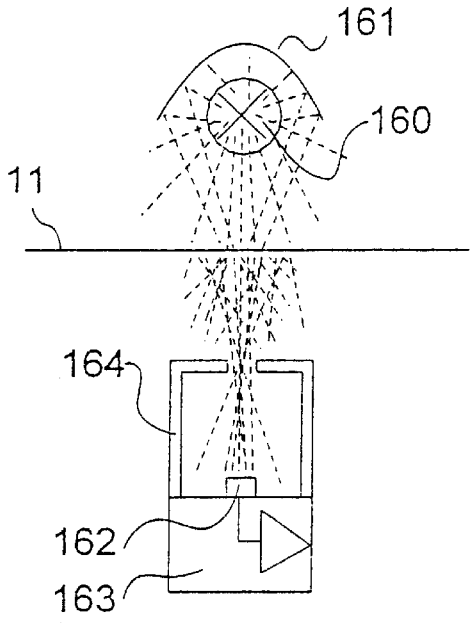
FIG. 3*a* is a schematic view of an embodiment of a sensor array for transmission measurement and reflection measurement.
FIG. 3*b* is a schematic view of an embodiment of a sensor array for transmission measurement and reflection measurement.
Figure 3:
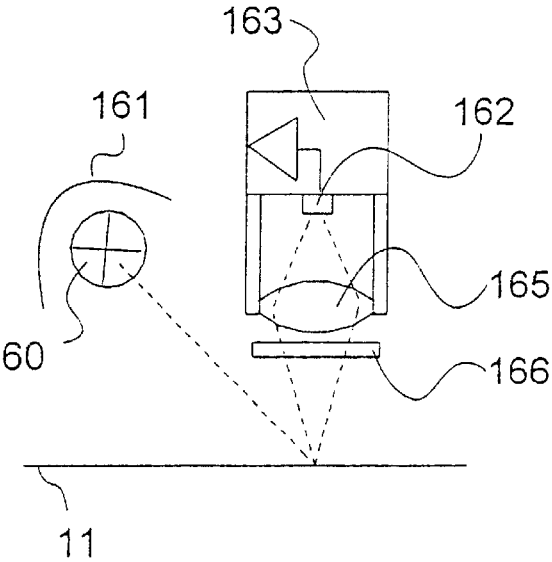

FIGS. 3*a* and 3*b* shows two embodiments of the sensor. The sensor comprises a radiation source and a detector; the use of a spectral band pass filter, which operates in the wavelength range of 2.8 $\mu$m to 3 $\mu$m, is advantageous.

FIG. 3*a* shows a transmission measurement. The radiation of the source 160 is bundled by a paraboloid reflector 161 on the web. Scattering occurs there on the paper and the radiation is partially transmitted through the web 11. The detector contains a radiation-sensitive area 162, which consists of, e.g., a PbS or PbSe semiconductor. The detector also contains an electronic amplifier circuit 163. To make possible the local determination of the water content in the web, the sensor has a diaphragm 164. This guarantees that only the light scattered in a limited part of the web will be detected.

FIG. 3*b* shows a reflection array. In this example, the detector recognizes the radiation reflected by the web. An imaging lens 165 is used to limit the measurement to a small area. A spectral filter 166 is located in front of the detector in the beam path.

The two embodiments are only examples. The radiation of the source may also be bundled on a smaller spot for a local measurement instead of limiting the measuring field by means of diaphragms and lenses. A spectral filter may be used in the illumination path and in the detection path alike.

Figure 4:
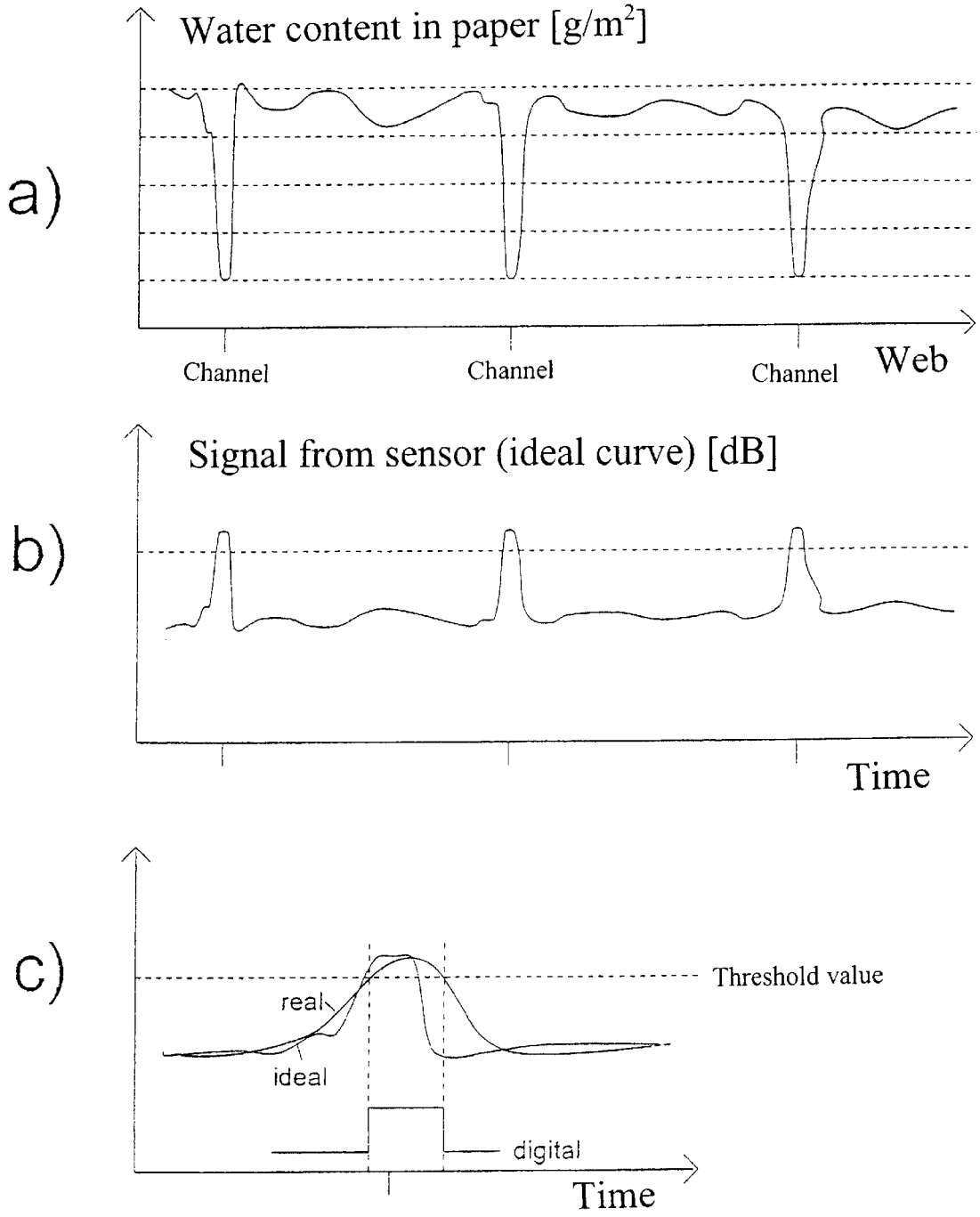
FIG. 4*a* is a diagram generally illustrating the water content in the paper.
FIG. 4*b* is a diagram illustrating a sensor signal resulting from the sensed water content.
FIG. 4*c* is a diagram illustrating a detail from the signal curve in FIG. 4*b*.

FIGS. 4*a* to 4*c* show diagrams generally illustrating the water content in the paper and the resulting signals of the sensor.

FIG. 4*a* shows the local water distribution as it occurs after the printing mechanism. The absolute values for the water content depend essentially on the number of printing mechanisms and the setting of the moistening. A minimum of the water content is recognized in the areas where a channel strip is located.

FIG. 4*b* shows the ideal curve of the signal sent by a sensor that monitors the moving web. During the absorption of electromagnetic radiation, there is an approximately logarithmic relationship between the incident and reflected or transmitted radiation in this case. The photosensitive sensors used have an approximately linear measuring behavior. The signals of the sensor can be expressed in dB. A reference is obtained for the measurement (0 dB) during the measurement of dry paper. The signal attenuation by the absorption of the IR radiation is an indicator of the amount of water in the paper.

FIG. 4*c* shows a detail from the signal curve in 4*b*. The amounts of water present in the paper have a low lateral diffusion compared with the width of the channel. It would be possible to obtain a high-resolution distribution by using a rapid sensor with a correspondingly small measuring field. However, the measured values are always smoothed in practice, which results from the time delay of the sensor reaction and the measured area. By comparing the measured value with a threshold value, a digital signal is obtained, which can be evaluated for regulating the cutting position. It is advantageous to perform an automatic adjustment of the threshold value such that it is set at a value at which the ratio of the detection time to the non-detection time corresponds to the ratio of the width of the channel strip to the length of the printing area.

While specific embodiments of the invention have been shown and described in detail to illustrate the application of the principles of the invention, it will be understood that the invention may be embodied otherwise without departing from such principles.

What is claimed is:

1. A process for detecting the position of a paper web, comprising the steps of:

wet printing the paper web providing the paper web with moistened areas to which moistening agent has been transferred and areas onto which no moistening agent has been transferred provided a moistening agent-free strip between moistened areas;

detecting a a moistening agent-free strip between moistened areas; and regulating the position of the web based on the detecting.

2. A process in accordance with claim 1, wherein the strip free from moistening agent is detected by measuring of the moistening agent or measuring the water content in the paper web.

3. A process in accordance with claim 2, wherein the moistening agent-free strip is detected by an infrared sensor system.

4. A process in accordance with claim 3, wherein the infrared sensor system measures the absorption of electromagnetic radiation in a wavelength range of 2.8 $\mu$m to 3 $\mu$m, 1.4 $\mu$m to 1.5 $\mu$m.

5. A process in accordance with claim 1, wherein the detection of the moistening agent-free strip is performed with a sensor system in reflection arrangement and/or transmission arrangement set-up.

6. A process in accordance with claim 1, further comprising: performing a reference measurement a non-moistened strip at the edge of the paper web.

7. A process in accordance with claim 1, comprising regulating the position of the paper web based on the position of the paper web determined used as the actual value for the regulating.

8. A device for detecting the position of a paper web in wet offset printing, comprising:

a location applying the paper web with moistening agent to form moistened areas to which moistening agent has been transferred and areas onto which no moistening agent has been transferred provided each as a moistening agent-free strip between moistened areas;

at least one sensor for detecting a moistening agent in the paper web; and means for regulating the feed or relative position of the pager web based on the sensor.

9. A device in accordance with claim 8, wherein said sensor is an infrared sensor.

10. A device in accordance with claim 8, wherein said sensor has a radiation source, wherein the sensor is arranged in a reflection set-up and/or transmission set-up.

11. A device in accordance with claim 8, further comprising a regulating device connected to at least one sensor.

12. A process in accordance with claim 1, further comprising forming a reference based on an operation of equal periodicity including a periodic cutting operation or a printing operation on a paper web or of the detection of a moistening agent-free strip.

13. A process in accordance with claim 12, further comprising cutting the paper web based on the detected moistening agent-free strip and the reference relating the detection location to the cutting location.

14. A wet offset printing system, comprising:

a location applying a first paper web with moistening agent to form moistened areas to which moistening agent has been transferred and areas onto which no moistening agent has been transferred provided as a moistening agent-free strip between moistened areas;

a location applying a second paper web with moistening agent to form moistened areas to which moistening agent has been transferred and areas onto which no moistening agent has been transferred provided as a moistening agent-free strip between moistened areas; and a sensor for detecting a moistening agent-free strip of said first paper web;

another sensor for detecting a moistening agent-free strip of said second paper web;

combining the first paper web and said second paper web to form a web bundle downstream of said sensor and said another sensor;

a cutter cutting the web bundle, the position of said bundle relative to said web bundle being regulated based on a reference of a location of said sensor and said another sensor to said cutter.

* * * * *